US006574968B1

(12) United States Patent
Symko et al.

(10) Patent No.: US 6,574,968 B1
(45) Date of Patent: Jun. 10, 2003

(54) HIGH FREQUENCY THERMOACOUSTIC REFRIGERATOR

(75) Inventors: Orest G. Symko, Salt Lake City, UT (US); Ehab Abdel-Rahman, Slc, UT (US); DeJuan Zhang, Beijing (CN); Thierry Klein, Saint Martin d'Heres (FR)

(73) Assignee: University of Utah, Salt Lake City, UT (US)

( * ) Notice: Subject to any disclaimer, the term of this patent is extended or adjusted under 35 U.S.C. 154(b) by 0 days.

(21) Appl. No.: 09/898,539

(22) Filed: Jul. 2, 2001

(51) Int. Cl.[7] ..... F25B 9/00
(52) U.S. Cl. ..... 62/6; 60/520
(58) Field of Search ..... 62/6; 60/517, 520

(56) References Cited

U.S. PATENT DOCUMENTS

| | | | | |
|---|---|---|---|---|
| 4,398,398 A | | 8/1983 | Wheatley et al. | |
| 4,489,553 A | | 12/1984 | Wheatley et al. | |
| 4,584,840 A | | 4/1986 | Baumann | |
| 4,953,366 A | | 9/1990 | Swift et al. | |
| 5,303,555 A | | 4/1994 | Chrysler et al. | |
| 5,339,640 A | | 8/1994 | Reinke | |
| 5,456,082 A | * | 10/1995 | Keolian et al. | 62/6 |
| 5,561,984 A | | 10/1996 | Godshalk et al. | |
| 5,647,216 A | | 7/1997 | Garrett | |
| 5,673,561 A | | 10/1997 | Moss | |
| 5,813,234 A | | 9/1998 | Wighard | |
| 5,857,319 A | | 1/1999 | Sattelmayer | |
| 5,857,340 A | | 1/1999 | Garrett | |
| 5,865,167 A | | 2/1999 | Godik | |
| 5,892,293 A | | 4/1999 | Lucas | |
| 5,901,556 A | | 5/1999 | Hofler | |
| 5,953,921 A | * | 9/1999 | Garrett | 62/6 |
| 5,996,345 A | * | 12/1999 | Hofler | 60/517 |
| 6,164,073 A | * | 12/2000 | Swift et al. | 60/721 |
| 6,385,972 B1 | * | 5/2002 | Fellows | 60/517 |

* cited by examiner

*Primary Examiner*—Ronald Capossela
(74) *Attorney, Agent, or Firm*—Morriss, Bateman, O'Bryant & Compagni

(57) ABSTRACT

A thermoacoustic refrigerator having a relatively small size which utilizes one or more piezoelectric drivers to generate high frequency sound within a resonator at a frequency of between about 4000 Hz and ultrasonic frequencies. The interaction of the high frequency sound with one or more stacks create a temperature gradient across the stack which is conducted through a pair of heat exchangers located on opposite sides of each stack. The stack is comprised of an open-celled material that allows axial, radial, and azimuthal resonance modes of the resonator within the stack resulting in enhanced cooling power of the thermoacoustic refrigerator.

42 Claims, 13 Drawing Sheets

HIGH FREQUENCY THERMOACOUSTIC REFRIGERATOR

BACKGROUND

The present application has been at least partially funded by the Office of Naval Research contract numbers PE 61153 N and N00014-93-1-1126.

1. Field of the Invention

The present invention relates generally to thermoacoustic refrigerators and, more specifically, to a thermoacoustic refrigerator having a relatively small size which utilizes one or more piezoelectric drivers to generate high frequency sound within a resonator. The interaction of the high frequency sound with one or more stacks create a temperature difference across the stack which is thermally anchored at each end to a pair of heat exchangers located on opposite sides of each stack.

2. Background of the Invention

Since the discovery by Merkli and Thomann that cooling can be produced by the thermoacoustic effect in a resonance tube, research has concentrated on developing the effect for practical applications. One approach in the art has been to increase the audio pumping rate. While the experiments of Merkli and Thomann used frequencies of around 100 Hz, Wheatley et al. successfully raised the operating frequency to around 500 Hz and achieved impressive cooling rates in their refrigerator. This has encouraged others to build various configurations of thermoacoustic refrigerators.

An important element in the operation of a thermoacoustic refrigerator is the special thermal interaction of the sound field with a plate or a series of plates known as the stack. It is a weak thermal interaction characterized by a time constant given by $\omega\tau \approx 1$ where $\omega$ is the audio pump frequency and $\tau$ is the thermal relaxation time for a thin layer of gas to interact thermally with a plate or stack. The amount of gas interacting with the stack is determined approximately by the surface area of the stack and by a thermal penetration depth $\delta_k$ given by:

$$\delta_k = (2K/\omega)^{1/2}$$

Here K represents the thermal diffusivity of the working fluid. By increasing $\omega$, the weak coupling condition is met by a reduction of $\delta_k$ and hence of $\tau$. The work of acoustically pumping heat up a temperature gradient as in a refrigerator is essentially performed by the gas within approximately the penetration depth. The amount of this gas has an important dependence on the frequency of the audio drive. In a high frequency refrigerator, smaller distances and masses are utilized thus making the heat conduction process relatively quick.

Each of the prior art thermoacoustic refrigerators are relatively complicated to manufacture and thus expensive. In addition, thermoacoustic refrigerators known in the art tend to be massive and typically not well suited for use on a very small level such as for use in cooling semiconductors and other small electronic devices or biological samples. Thus, it would be advantageous to provide a thermoacoustic refrigerator that can be made relatively small with a fast response time while retaining good cooling abilities. In addition, it would be advantageous to provide a thermoacoustic refrigerator that operates relatively efficiently and that is relatively simple and economical to manufacture.

SUMMARY OF THE INVENTION

In accordance with the principles of the present invention, a high frequency thermoacoustic refrigerator is provided.

Preferably, the thermoacoustic refrigerator operates at a frequency of at least 4,000 Hz. Utilizing a driver that operates at a high frequency allows the device to be made smaller in size as the wavelength at such a frequency is short. Thus, it is a principle object of the present invention to provide a compact thermoacoustic refrigerator in which its dimensions scale with the wavelength of the audio drive.

The present invention provides a thermoacoustic refrigerator which produces relatively large temperature difference across the stack to attain correspondingly relatively low refrigeration temperatures.

The present invention also provides a thermoacoustic refrigerator that utilizes large temperature oscillations with small displacements along the s tack leading to a large critical temperature gradient across the stack in a thermoacoustic refrigeration.

The present invention further provides a thermoacoustic refrigerator that can operate in the ultrasonic range.

The present invention also provides a thermoacoustic refrigerator that is simple and inexpensive to manufacture and is relatively compact.

The present invention also provides a thermoacoustic refrigerator that is well-suited for working gas high pressure operation.

The present invention further provides a thermoacoustic refrigerator that can be easily adapted for miniaturization.

The present invention also provides a thermoacoustic refrigerator that has a quick response and fast equilibration rate for electronic device heat management.

The present invention further provides a thermoacoustic refrigerator that utilizes a convenient frequency range for a piezoelectric driver since such drivers are relatively light, small, efficient, and inexpensive.

The present invention also provides a thermoacoustic refrigerator in which some components, such as heat exchangers and stack, can be fabricated using photolithography, MEMS, and other film technologies.

The present invention also provides a thermoacoustic refrigerator in which the power density of the device can be raised by increasing the frequency and thus reducing its size.

The present invention further provides a thermoacoustic refrigerator that is useful for many applications that require small compact refrigerators, for example to provide a relatively simple, compact, and inexpensive device that can be used for cooling small electronic components and small biological systems.

The thermoacoustic refrigerator is comprised of a resonator that also functions as a housing for an acoustic driver, a stack and a pair of heat exchangers positioned on opposite sides of the stack. The driver is a piezoelectric or other similar device that can operate at high frequencies of at least 4,000 Hz. The stack may be formed from random fibers that are comprised of a material having poor thermal conductivity, such as cotton or glass wool or an aerogel but with a relatively large surface area. The heat exchangers are preferably comprised of a material having good thermal conductivity such as copper. Finally, the resonator contains a working fluid, such as air or other gases at 1 atmosphere or higher pressures.

A compact thermoacoustic refrigerator in accordance with the principles of the present invention includes an elongate resonator defining a generally cylindrical chamber having first and second closed ends and having a length approximately equal to ½ the wavelength of sound produced by the driver.

In one embodiment, a thermoacoustic refrigerator has a length that is adjustable for tuning purposes as with a mechanism for moving one or both ends of the chamber closer to or further away from each other and/or a moving mechanism for positioning the stack-heat exchanger assembly within the chamber.

In another embodiment, a thermoacoustic refrigerator in accordance with the principles of the present invention includes a housing comprised of individual segments or portions that are comprised of materials having relatively high thermal conductivity. These portions are spaced by segments or rings (in the case of a cylindrical housing) that thermally isolate adjacent section from each other. Each thermally isolated section is in contact with one heat exchanger contained therein such that as a heat exchanger changes in temperature, that change is conducted through the associated segment.

In yet another embodiment of the present invention, a thermoacoustic refrigerator includes a resonator which defines a generally cylindrical chamber having a length approximately equal to ½ wavelength of sound produced by an associated driver. A second stack is preferably disposed between a first stack and the second end of the resonator opposite the driver. With such a configuration, the first stack will produce a first temperature differential and the second stack will produce a second temperature differential by which the combined change in temperature can be used to raise its efficiency. The same applies to higher mode resonators (e.g., 1 wavelength, 1½ wavelength, 2 wavelength, etc.).

In another embodiment of the present invention, a thermoacoustic refrigerator includes a first driver located at one end of the resonator and a second driver located at an opposite end of the resonator. A plurality of stacks are located at optimal locations within the resonator depending upon the location of the standing waves within the resonator.

In still another embodiment, such a thermoacoustic refrigerator includes two stacks, one located proximate the first driver and a second stack located proximate the second driver. The stacks are located at the location of maximum cooling efficiency within the resonator as determined by the standing wave within the resonator generated by the drivers.

In still another preferred embodiment of a thermoacoustic refrigerator of the present invention, the thermoacoustic refrigerator is provided with multiple stacks inside the resonator, each stack located within the resonator to achieve the greatest temperature difference across each stack. The location of each stack corresponds to a particular location relative to the standing wave generated within the resonator by the pair of drivers.

In another embodiment of the present invention, a thermoacoustic refrigerator is comprised of a rectangularly-shaped resonator, a driver and a pair of stacks located at optimum locations within the resonator to attain the highest temperature difference across the stack.

In another embodiment of the present invention, a thermoacoustic refrigerator is comprised of a rectangularly-shaped resonator, a pair of drivers located in proximate the center of the resonator and facing in opposite directions, and a pair of stacks for each driver positioned on opposite ends of the resonator.

In still another embodiment of the present invention, a method of cooling utilizing thermoacoustic technology comprises providing a sealed elongate chamber with first and second heat exchangers disposed therein and a random fiber stack thermally coupled to the heat exchangers. High frequency sound is generated within the sealed chamber which causes a standing wave in the chamber. A corresponding heat flow from the cold end of the stack to the hot end cooling the cold side heat exchanger and depositing the heat at the hot heat exchanger. By utilizing a chamber having a diameter equal to its length and a random stack material, a mixture of axial, radial and azimuthal resonance modes can be achieved. The radial and azimuthal modes provide thermal mixing in the random stack while the axial mode provides axial heat pumping along the stack between the cold and hot heat exchangers. As the thermoacoustic refrigerators of the present invention are reduced in size, the radial and azimuthal modes help to provide more efficient heat pumping thus increasing the efficiency of the refrigerator.

Since the optimum position of the stack within the chamber resulting in the optimal temperature difference across the stack is a function of the length of the stack in association with the frequency and the wavelength of the sound wave, it may be desirable to allow adjustment of the length of the resonator or adjustment of the position of the stack/heat exchanger unit at the optimal position in the resonator to "tune" the resonator or stack/heat exchanger, as the case may be, for maximum efficiency. Thus, the method of cooling further includes adjusting the length of the chamber or positioning the stack and heat exchangers to maximize the temperature difference between the first and second heat exchangers for a given driver.

Other objects and advantages of the present invention will become apparent upon reading the following detailed description and appended claims, and upon reference to the accompanying drawings.

DETAILED DESCRIPTION OF THE PREFERRED EMBODIMENTS OF THE INVENTION

Reference is now made to the drawings wherein like parts are designated with like numerals throughout. It should be noted that the present invention is discussed in terms of a thermoacoustic refrigerator operating at a frequency of approximately 4,000 Hz or more. After understanding the present invention, however, those skilled in the art will appreciate that the frequency and size of components used therewith can be readily miniaturized in accordance with the teachings provided herein.

Figure 1:
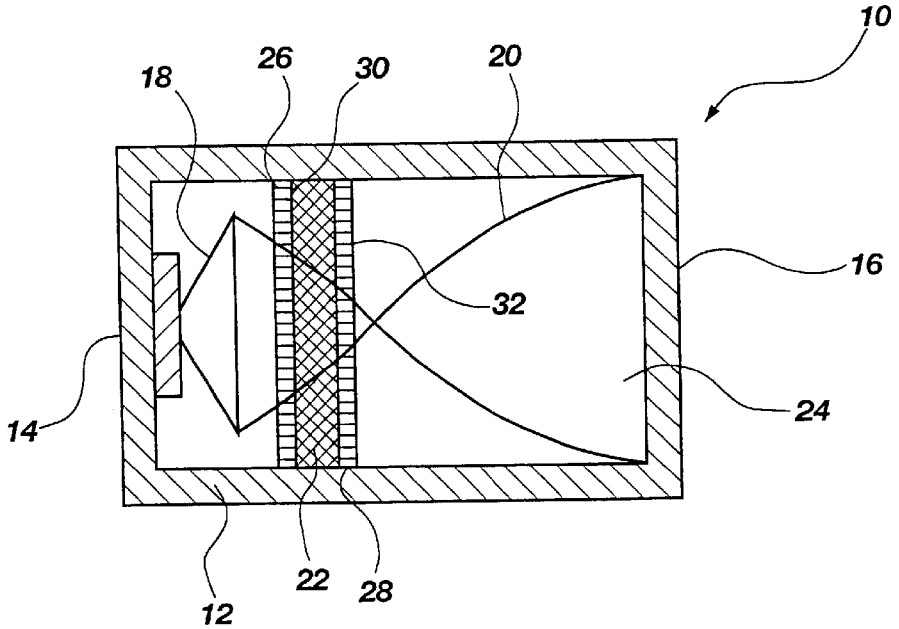
FIG. 1 is a cross-sectional side view of a first embodiment of a compact thermoacoustic refrigerator in accordance with the principles of the present invention.

Referring now to FIG. 1, a compact thermoacoustic refrigerator, generally indicated at 10, is illustrated. The thermoacoustic refrigerator 10 is comprised of a resonator 12 forming an enclosure for housing the components of the thermoacoustic refrigerator 10. The resonator 12 has a first closed end 14 and a second closed end 16 and is preferably of a generally cylindrical configuration for simplicity but other geometries, such as rectangular, square, hexagonal, octagonal or other symmetric shapes, are also contemplated. For manufacturing purposes, the resonator 12 has a generally symmetrical shape. Housed within the chamber defined by the resonator 12 proximate the first end 14 is a driver 18. The driver 18 is capable of generating high frequency sound. In addition, the length of the resonator is configured such that approximately a half wavelength 20 is produced by the driver 18 within the resonator 12. Positioned between the driver 18 and the second end 16 is a stack 22. The stack 22, as will be described in more detail, has a density that is inversely proportionate to the thermal penetration depth of a working fluid 24 contained within the resonator 12. The stack 22 is essentially "sandwiched" between a pair of heat exchangers 26 and 28. That is, the exchangers 26 and 28 are adjacent to and abut the ends 30 and 32, respectively, of the stack 22. Preferably, the heat exchanger 26 comprises the hot exchanger as it is closest to the driver 18 which will typically produce an amount of heat itself. The heat exchanger 28 is thus the cold exchanger. Positioning the stack 22 and heat exchangers 26 and 28 at a different point within the resonator, however, could result in the heat exchanger 26 being the cold exchanger.

In order to produce a device that is relatively simple and inexpensive to manufacture, the working fluid is preferably air at 1 atmosphere. It is contemplated, however, that other gases and combinations of gases at higher pressures may be utilized to increase the efficiency of cooling across the stack 22. In addition, because it is desirable to operate the thermoacoustic refrigerator at higher frequencies in order to decrease its size, the driver 18 preferably comprises a piezoelectric device. Likewise, the stack 22 is comprised of random fibers preferably in the form of cotton or glass wool or an aerogel (e.g., a silicon dioxide glass structure having a density of approximately 0.1 grams/cc) or some other similar material known in the art which will provide high surface area for interaction with sound but low acoustic attenuation. That is, a stack is essentially a randomly configured, open-celled material having.a relatively high surface area. While other random or non-random materials may be employed in accordance with the present invention, it is highly preferred to select an open celled stack material that will make use of radial and/or azimuthal resonance modes of the sound wave. Such resonance modes, in addition to the axial resonance mode (i.e., the resonance mode in axial alignment with the stack) enhances the cooling power of the thermoacoustic refrigerator in accordance with the principles of the present invention. Thus, such additional resonance modes contribute to the cooling power of the device. Furthermore, by configuring the resonator 12 to define an internal chamber that is approximately the same length as it is wide (i.e., the length is approximately equal to the effective length), the radial and/or azimuthal modes of the sound are enhanced. Such a stack is placed in contact with the heat exchangers 26 and 28, comprised of a material having a high thermal conductivity such as copper having a similar or identical configuration, if desired.

The components utilized in accordance with the present invention have been chosen for simplicity realizing that they are far from ideal. Those skilled in the art, however, will appreciate that various modifications to and equivalent components to those disclosed herein may increase the efficiency of the thermoacoustic refrigerator without departing from the spirit and scope of the present invention.

Figure 2:
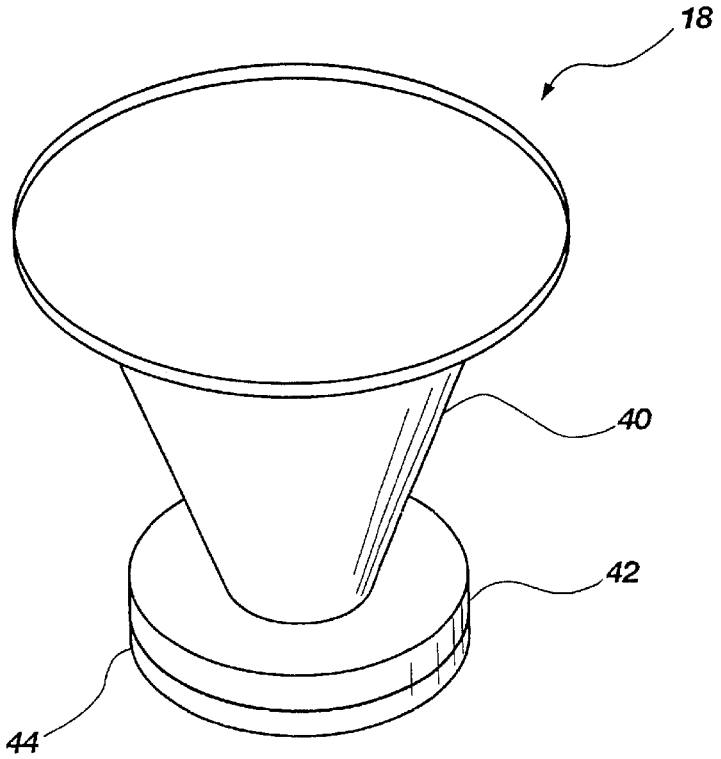
FIG. 2 is a perspective side view of a bimorph piezoelectric driver cone loaded in accordance with the principles of the present invention.

As illustrated in FIG. 2, the acoustic driver 18 is a piezoelectric driver of a bimorph or monomorph type, an example of one being the Motorola KSN 1046, horn-loaded for better impedance matching. This model has a relatively high sensitivity and broad frequency response. Its characteristics include a mass of 1.3 g, a sensitivity ~95 dB/watt/m, which may vary by a few decibels depending on the unit, and a frequency response of 4–27 kHz. In addition, such drivers vary widely in frequency response depending on the particular unit. A horn cone 40 for such a model has a maximum diameter of about 4 cm. The driver efficiency can be as high as 50–90%, depending on the load. Instead of using a cone with the piezo element, it is also possible to tune the piezo.

In a bimorph driver 18, two piezoelectric discs 42 and 44 are bonded together on each side of a brass shim (not shown). The piezoelectric discs 42 and 44 change lengths in opposite direction with applied voltage causing a large bending action. When coupled to a cone diaphragm 40, sound waves are.transmitted from the cone 40. This device behaves similarly to a bimetallic strip which flexes upon heating.

This type of driver 18 has ideal characteristics for use in a high frequency refrigerator 10. Dissipation power losses are very small since a piezoelectric is a capacitor with a dielectric. The model previously described has a capacitance C of 145 nano Farads whose losses come from the hysteresis behavior of the dielectric. Compared to the electromagnetic drivers utilized in the prior art whose voice coils typically have ~8 ohms resistance, the dissipation power is much smaller for the piezoelectric driver 18 than for the regular electromagnetic driver. In addition, the piezoelectric driver 18 is a voltage device while an electromagnetic driver is a current device. Furthermore, the piezoelectric driver 18 is very light and thus useful for such applications as small electronics. Its efficiency is much higher than that of the electromagnetic driver. Piezoelectric drivers can be approximately 70 percent efficient, are very light, and dissipate much less heat than electromagnetic drivers. Moreover, piezoelectric drivers are non-magnetic thus not emitting an magnetic field which can have certain utility in various electronic or other applications where electromagnetic fields can effect the performance of the circuitry, electronic device or system.

Figure 3:
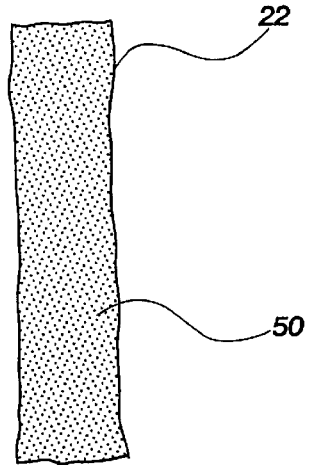
FIG. 3, is a cross-sectional side view of a stack formed from random fibers in accordance with the principles of the present invention.

Referring now to FIG. 3, a cross-sectional view of the stack 22 is illustrated. Because of the relatively small size of the stack 22 of the present invention (having a thickness of Δx 5 mm or less), a conventional stack consisting of parallel plates of Mylar would not be easy to assemble. It would be difficult to maintain small uniform spacing and difficult to make good thermal contact with the heat exchangers 26 and 28 at each end of the stack 22. As such, the present invention utilizes a random fiber material, such as cotton wool 50, to form the stack 22. The cotton wool 50 is pressed to the desired thickness, e.g., 0.5 cm. Cotton wool 50 may have a density of approximately 0.08 g/cm$^3$, a thermal conductivity of 0.04 W/m ° C. for each fiber, and an average fiber diameter of 10 $\mu$m. As such, cotton wool provides an enormous surface area to better accommodate the transfer of heat from the working fluid 24 to the fibers and is thus quite efficient. Indeed, the number of fibers in stack 3 cm in diameter is approximately $4\times10^6$. Furthermore, a typical effective total perimeter of the fibers of such a stack is approximately 126 m with an effective cross-sectional area for heat pumping of $7.5\times10^{-3}$ m$^2$ and a total active area of stack exposed to sound field of approximately 7.5×103 cm$^2$.

Figure 4:
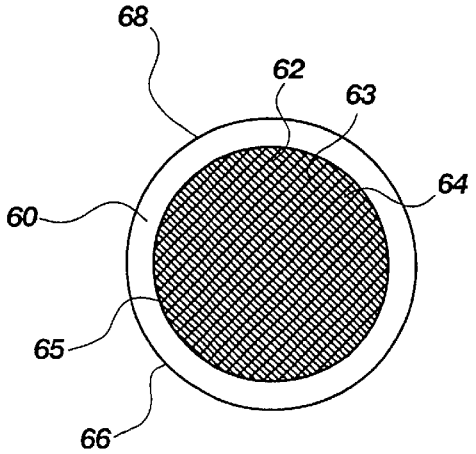
FIG. 4 is a schematic top view of a first embodiment of a heat exchanger in accordance with the principles of the present invention.
Figure 5:
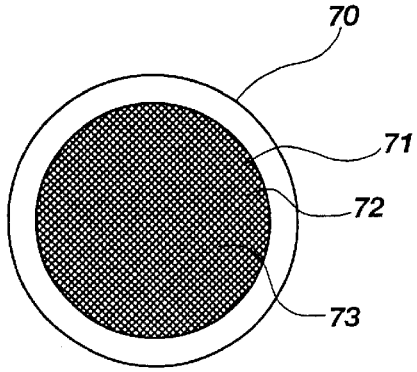
FIG. 5 is a schematic top view of a second embodiment of a heat exchanger in accordance with the principles of the present invention.

FIGS. 4 and 5 illustrate heat exchangers 60 and 70, respectively, in accordance with the present invention. FIG. 4 shows a heat exchanger fabricated using photolithography to form the heat exchanger 60 from a copper sheet. The heat exchanger 60 has square holes, such as holes 62, 63, and 64, having a dimension of 0.5 mm×0.5 mm for the size of the driver 18 previously mentioned with solid spacers, such as spacers 65 and 66 having dimensions of 0.8 mm×0.8 mm. Such an exchanger 60 provides a sound transparency of about 25%. For application with a 4 cm driver cone 40 the diameter will preferably be about 3.4 cm and have a thickness of about 0.3 mm. The heat exchanger 60 has an outer ring 68 for contacting the resonator 12 and transferring heat thereto.

FIG. 5 shows another preferred embodiment of a heat exchanger 70 in accordance with the present invention. The heat exchanger 70 may be formed from a copper screen, flattened by a press, with square holes, such as holes 71, 72 and 73 having dimensions of, for example, 0.8 mm×0.8 mm and a wire to wire distance of 1.2 mm for adjacent wires. For such a heat exchanger, the sound transparency is approximately 44%. When such a heat exchanger 70 is utilized as the hot heat exchanger 26, to improve heat transfer at the hot heat exchanger (since it handles more heat than the cold one), the heat exchanger 70 may be thermally anchored to a large (e.g., 0.5 cm thick) copper heat exchanger or heat sink (not shown). Although thin, the heat exchangers 60 and 70 maintain heat flows of approximately 2 watts without creating a substantial ΔT across the heat exchanger (ΔT is less than 0.1° C.).

The working fluid may simply be comprised of air at one atmosphere in accordance with the present invention. The use of air provides a simple means of manufacture in that more complex pressurization and assembly techniques are not required. The properties of air include a thermal conductivity of 0.26 mW/cm/° C., a density at 1 atmosphere and 20° C. of 0.00121 g/cm$^3$, a viscosity at 20° C. of 18.1 $\mu$poise, the speed of sound at 20° C. equal to 344 m/sec, thermal penetration depth at 5 kHz of 0.05 mm, viscous penetration depth at 5 kHz of 0.035 mm and a Prandtl number of 0.707. It is contemplated in accordance with the principles of the present invention that other gases will increase the performance of the thermoacoustic refrigerator. For example, better performance is expected in a mixture of Argon and Helium. For a specific mixture of $Ar_{0.36}He_{0.64}$ the thermal conductivity is 0.09 W/m/K, the Prandtl number is 0.351 and the speed of sound at 20° C. is 497 m/s.

Figure 6:
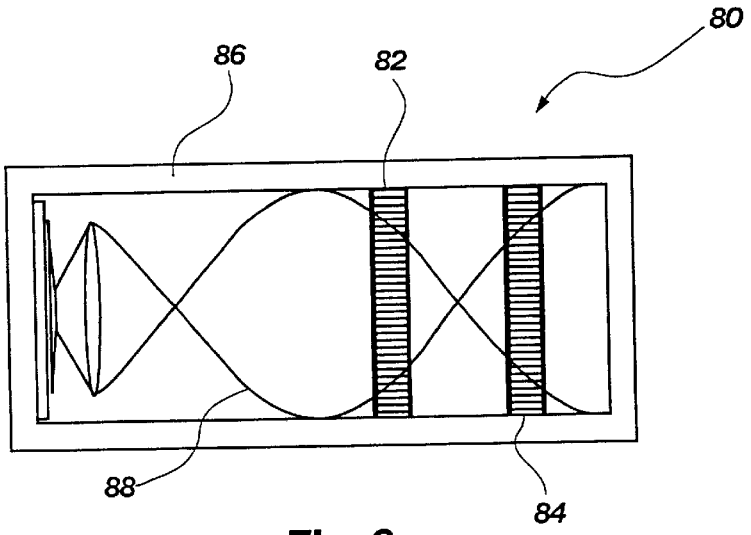
FIG. 6 is a cross-sectional side view of a second embodiment of a compact thermoacoustic refrigerator in accordance with the principles of the present invention.

As shown in FIG. 1, preferably, the resonator 12 has a relatively simple geometry. For example, in the preferred embodiment the resonator is cylindrical with both ends 14 and 16 being closed, with a drive at one end. Such tube resonator 12 may be a half-wave resonator tuned to 5000 Hz as shown in FIG. 1 or a double half-wave resonator 80 tuned to 5000 Hz (i.e., the half-wave part is tuned to 5000 Hz and the resonator contains one full wave) as shown in FIG. 6. The thermoacoustic refrigerators of the present invention may have a length of approximately 4 cm to 0.85 cm or smaller with the frequency reaching the ultrasonic range (e.g., 24 kHz or more). Thus, microminiaturization can be achieved by decreasing the size of the resonator with a corresponding increase in sound frequency.

In the present embodiment, the operating frequency is between 4 and 5 kHz with the corresponding wavelength in air at 1 atmosphere from 8 to 6.8 cm. Hence a half-wave resonator at 5,000 Hz would be approximately 3.4 cm long. This type of resonator provides the opportunity to make a compact refrigerator. A double half-wave resonator, however, tuned to about 5,000 Hz is twice as long as the half-wave resonator since it contains two half-waves of the same wavelength as the half-wave resonator. This is shown in FIG. 6 with the stacks 82 and 84 and associated heat exchangers positioned at the appropriate positions with respect to the pressure standing wave 88 in the resonator 86.

In the double half-wave acoustic refrigerator 80, two stack-heat-exchanger units 82 and 84 are placed at appropriate positions in the double half-wave resonator 86. The resonator 86 has a length approximately equal to one full wavelength 88 of sound. In such a system, one stack produced a first $\Delta T_1$ while the other one produced a second $\Delta T_2$ at the same time. Difference in first and second temperature changes may be due to the positioning of the stacks 82 and 84 within the resonator 86. As such, by thermally isolating each of the stacks 82 and 84, the two units 82 and 84 could be attached thermally in tandem for improved efficiency. Accordingly, the geometry of the double half-wave resonator 80 provides the option of having two or more stacks which can be connected in tandem or in parallel.

Figure 7:
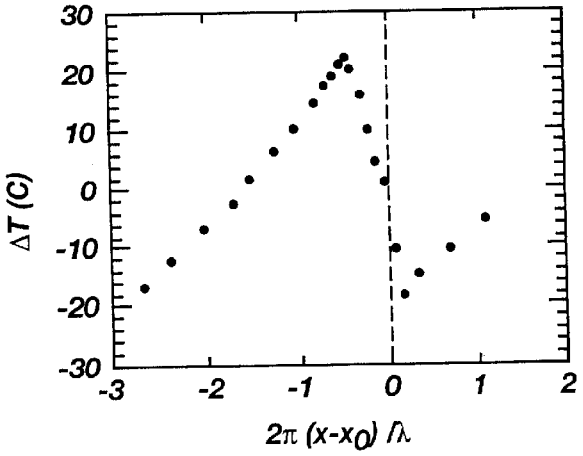
FIG. 7 is a graph representing the temperature change across a stack relative to the stack's position within a resonator in accordance with the principles of the present invention.

Experiments on the half-wave resonator 10 shown in FIG. 1, have indicated that the attained temperature difference ΔT across the stack 22 is a function of the position of the stack in the acoustic standing wave. Thus, ΔT across the stack is a function of the stack's position. At some point, the temperature change due to the pressure change of the sound field is balanced out by the fluid displacement in a temperature gradient and which leads to a critical temperature gradient $\nabla T_{crit}$. It is defined as:

$$\nabla T = \frac{\gamma - 1}{T_m \beta} \frac{T_m}{\pi} \tan(x/\pi)$$

where $\gamma$ is the ratio of isobaric to isochoric specific heats, $T_m$ is the mean temperature of the fluid, $\lambda$ is the radian length, $\beta$ is the thermal expansion coefficient, and x is the stack position relative to the pressure antinode. Experiments have demonstrated that the position of the stack relative to the acoustic standing wave affects the temperature change across the stack, with the spatial dependence normalized to the sound radian wave length. As illustrated in FIG. 7, the position of the stack results in a variation in $\Delta T$ of nearly 40° C. These results show how the position of the stack and the direction of the pressure gradient in the acoustic standing wave determine the sign and magnitude of $\Delta T$.

Figure 8:
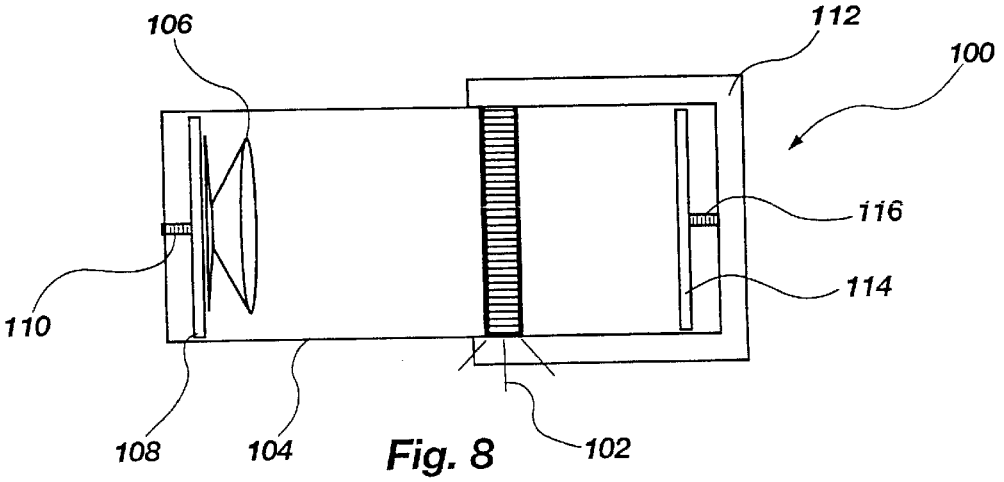
FIG. 8 is a cross-sectional side view of a third embodiment of a compact thermoacoustic refrigerator in accordance with the principles of the present invention.

Once the position of maximum $\Delta T$ is established, the stack can be fixed at that position to maximize the efficiency of the thermoacoustic refrigerator. There are a number of ways in which the stack 102 can be adjusted relative to the resonator 104 of the thermoacoustic refrigerator, generally indicated at 100. For example, as shown in FIG. 8, the driver 106 is attached to an adjustable disc 108 that can be longitudinally adjusted relative to the resonator 104 as with a threaded adjustment screw 110. Similarly on the distal end 112 of the resonator 104, a second adjustable disc 114 is adjustable in either direction relative to the longitudinal axis of the resonator 104 with an adjustment screw 116. As such, by adjusting either end of the resonator, the effective distance between the end of the resonator and the stack is varied, the length of the resonator 104 is changed and the position of a standing wave within the resonator 104 will shift.

Figure 9:
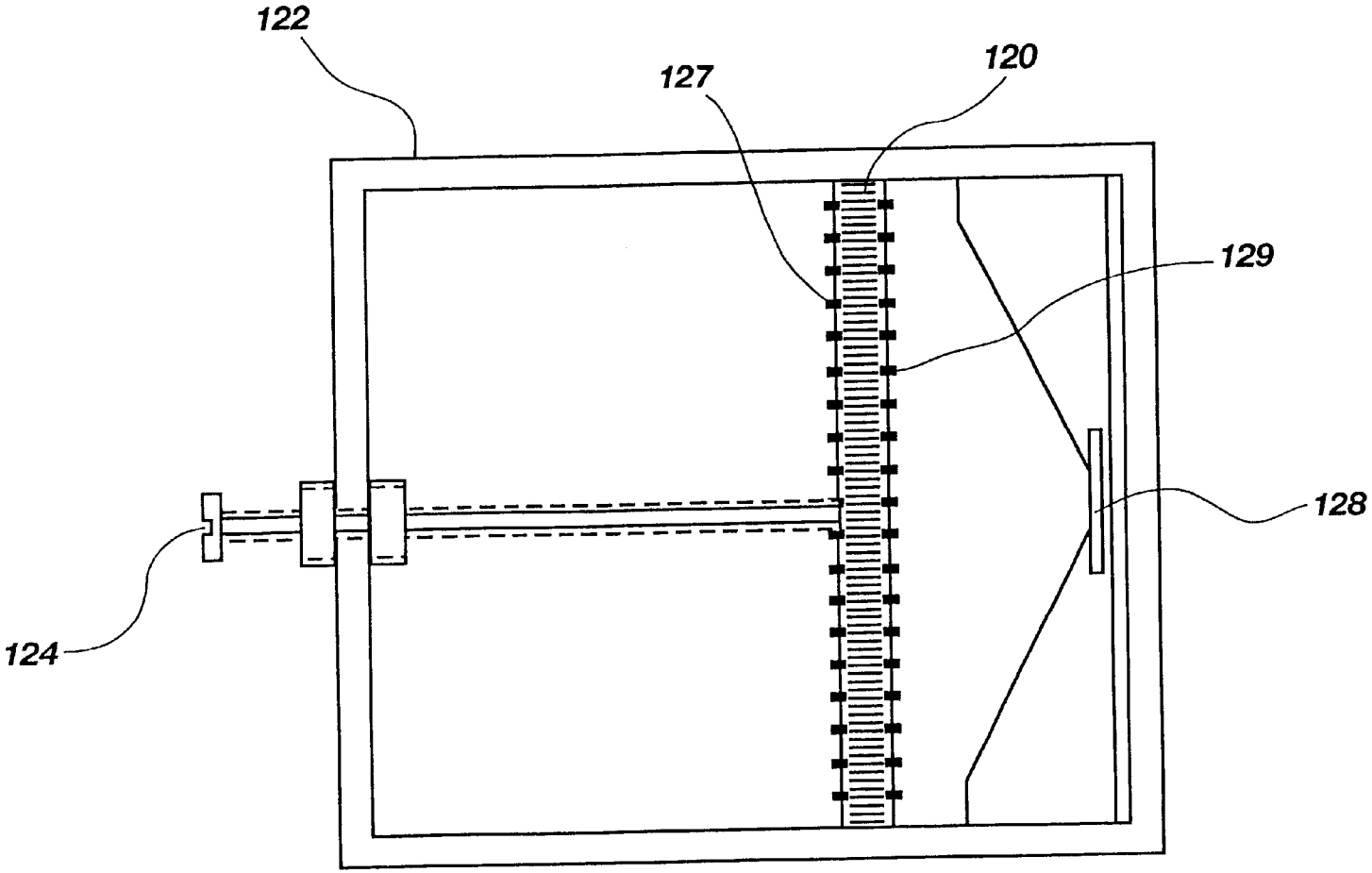
FIG. 9 is a cross-sectional side view of a fourth embodiment of a compact thermoacoustic refrigerator in accordance with the principles of the present invention.

Similarly as illustrated in FIG. 9, the stack 120 is adjustable relative to the resonator 122 with an adjustment screw 124 that can be rotated to move the stack 120 in either longitudinal direction relative to the resonator 122. As such, the stack can be effectively "tuned" to maximize the cooling effect produced by the acoustic driver 128 across the stack 120 to the cold heat exchanger 127 and hot heat exchanger 129.

Figure 10:
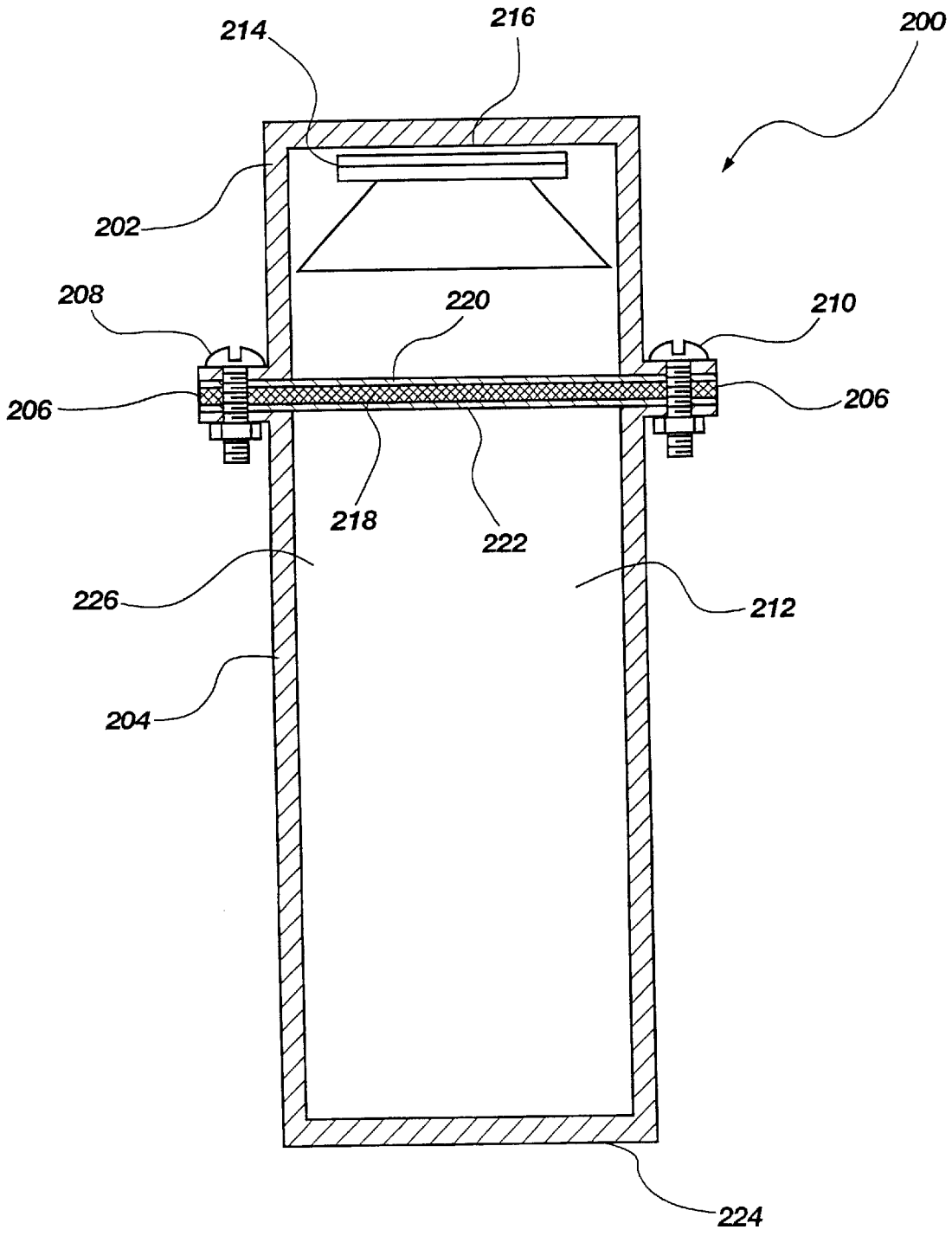
FIG. 10 is a cross-sectional side view of a fifth embodiment of a compact thermoacoustic refrigerator in accordance with the principles of the present invention.
Figure 11:
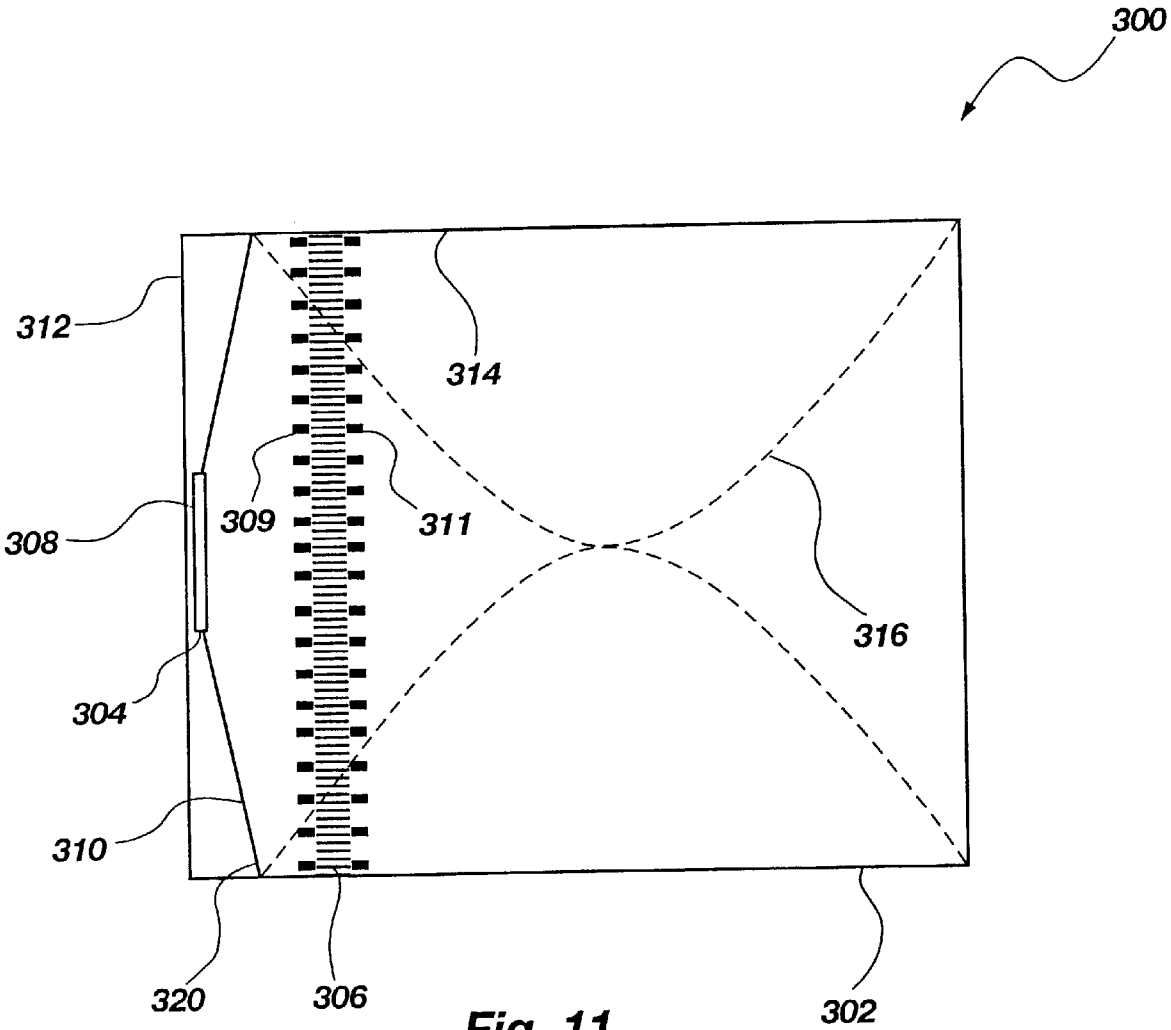
FIG. 11 is a cross-sectional side view of a sixth embodiment of a compact thermoacoustic refrigerator in accordance with the principles of the present invention.

Referring now to FIG. 10, a thermoacoustic refrigerator in accordance with the present invention, generally indicated at 200 comprises a first housing member 202, a second housing member 204 and a interposing ring member 206 held together as with bolts 208 and 210. The housing members 202 and 204 and ring member 206 form an elongate chamber or resonator 212. A piezoelectric driver 214 is disposed at one end 216 of the resonator 212 with the stack 218 positioned between the first and second housing members 202 and 204. The housing members 202 and 204 are preferably comprised of a material having a relatively high thermal conductivity while the ring member 206 has relatively poor thermal conductivity properties and thus insulate and thermally isolate the first and second housing members 202 and 204 from each other. The housing members 202 and 204 are in mechanical contact with the heat exchangers 220 and 222, respectively, in order to thermally conduct heat to or from the heat exchangers 220 and 222 as the case may be. Preferably, the heat exchanger 220 is a hot heat exchanger and the heat exchanger 222 is a cold heat exchanger. As such the distal end 224 of the housing member 204 or the cold heat exchanger can be placed in contact with another device, such as a semiconductor, to provide refrigeration for such a device.

It is preferable that such a refrigerator 200 operate at a sound intensity of at least 156 dB which corresponds to 0.4 W/cm$^2$. For a 3 cm diameter stack 218, an input acoustic power level is approximately 2.5 watts. At maximum power from the driver 214 it is readily achievable to form a temperature difference $\Delta T$ between the hot and the cold end of the stack of 50° C. In such a case, the stack 218 is preferably located just before the last pressure antinode away from the driver 214.

In yet another preferred embodiment of a thermoacoustic refrigerator, generally indicated at 300, in accordance with the present invention comprises a resonator housing 302 which houses a sound driver 304, a stack 306 and heat exchangers 309 and 311. The driver is comprised of a piezoelectric driver 308 mounted relative to a first end 312 of the resonator housing 302. The driver 304 also includes a cone structure 310 that extends from the piezoelectric driver 308 to the inner wall surface 314 of the housing 302. The cone structure 310 in combination with vibration from the piezoelectric driver 308 create a standing wave 316 within the housing 302. While the use of a cone is shown, it should be noted that depending on the size of the resonator, a cone may not be necessary as the driver itself could completely or nearly completely fill the diameter of the resonator. Moreover, while the driver has been discussed herein as comprising a piezoelectric driver, the driver may comprise any type of high frequency sound generating device whether currently known in the art or later developed.

In this preferred embodiment, the length of the resonator housing 302 is configured to be substantially equal to the length of one half of a wavelength of the sound generated by the piezoelectric driver 308. In addition, for a cylindrically-shaped resonator housing 302, the circumference of the driver cone 310 substantially matches the inner diameter of the resonator housing 302. In other geometric configurations, the driver cone 310 could.also be configured to extend to the inner wall 314 of the resonator housing 302. The driver cone 310 may be a separate component as is shown in FIGS. 1 and 2, or may be integrally formed into the first end 312 of the resonator housing, such that the driver cone 310 does not vibrate with movement of the piezoelectric driver 308. Likewise, the outer perimeter 320 of the driver cone 310 may be loosely mounted to the inner surface 314 of the resonator housing 302 with the piezoelectric driver 308 suspended within the housing 302 by the cone 310. The stack 306 and associated heat exchangers 309 and 311 are positioned relative to the standing wave 316 to be in a pressure gradient across the stack 306 with a hot side of the hot heat exchanger 309 facing the nearest pressure anti-node and a cold side of the cold heat exchanger 311 facing away from it. The relative position of the stack 306 to the resonator 302 is a function of the location of the standing wave 316 which can vary depending on the configuration of the device and the frequency of sound generated by the piezoelectric driver 308. Thus, while similarly configured devices can operate.

Figure 12:
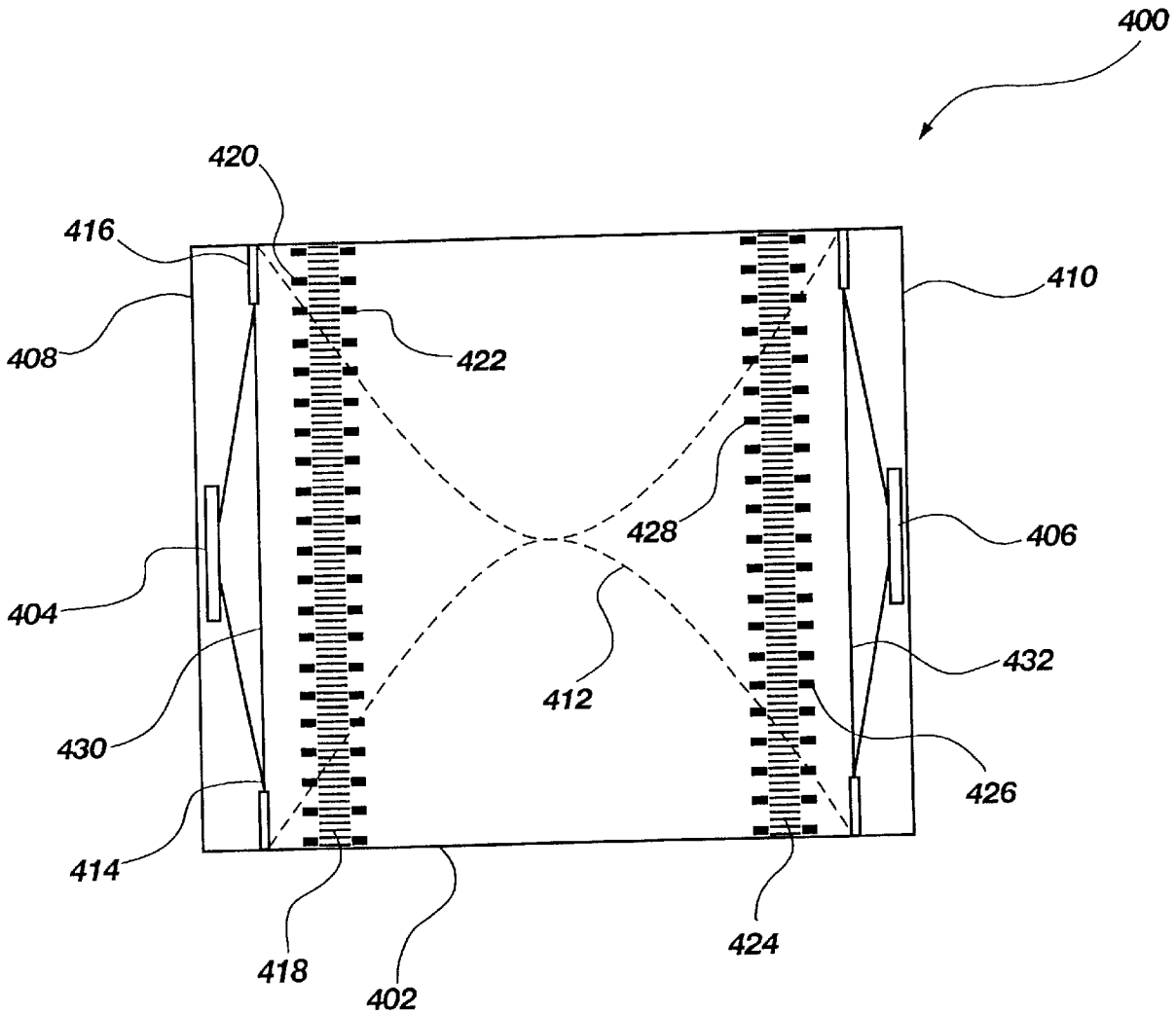
FIG. 12 is a cross-sectional side view of a seventh embodiment of a compact thermoacoustic refrigerator in accordance with the principles of the present invention.

In FIG. 12, a thermoacoustic refrigerator, generally indicated at 400, is comprised of a half wavelength resonator 402 which houses a pair of piezo drivers 404 and 406 mounted on opposite ends 408 and 410, respectively, of the resonator 402. The piezo drivers 404 and 406 face one another, are out of phase relative to one another and thus, form a standing wave 412 therein between. The outer circumference 414 of the driver 404 is abutted against or mounted to a radially extending ring member 416 in order to maintain the standing wave 412 in front of the driver 404. This allows the stack 418 to be located in a position relative to the standing wave that forms a larger temperature difference between the hot heat exchanger 420 and the cold heat exchanger 422. A similar, but opposite, arrangement is provided for the stack 424, cold hot heat exchanger 426 and cold heat exchanger 428. With such a configuration, the effective length of the resonator 402 is that distance between the fronts 430 and 432 of the drivers 404 and 406, respectively (in this case a half wavelength resonator). By utilizing a pair of drivers 404 and 406, each contributing to the standing wave, both stacks 418 and 424 will each provide substantially equal cooling power. Thus, for economy of space, in a single half wavelength resonator 402, the cooling power can be nearly doubled.

Figure 13:
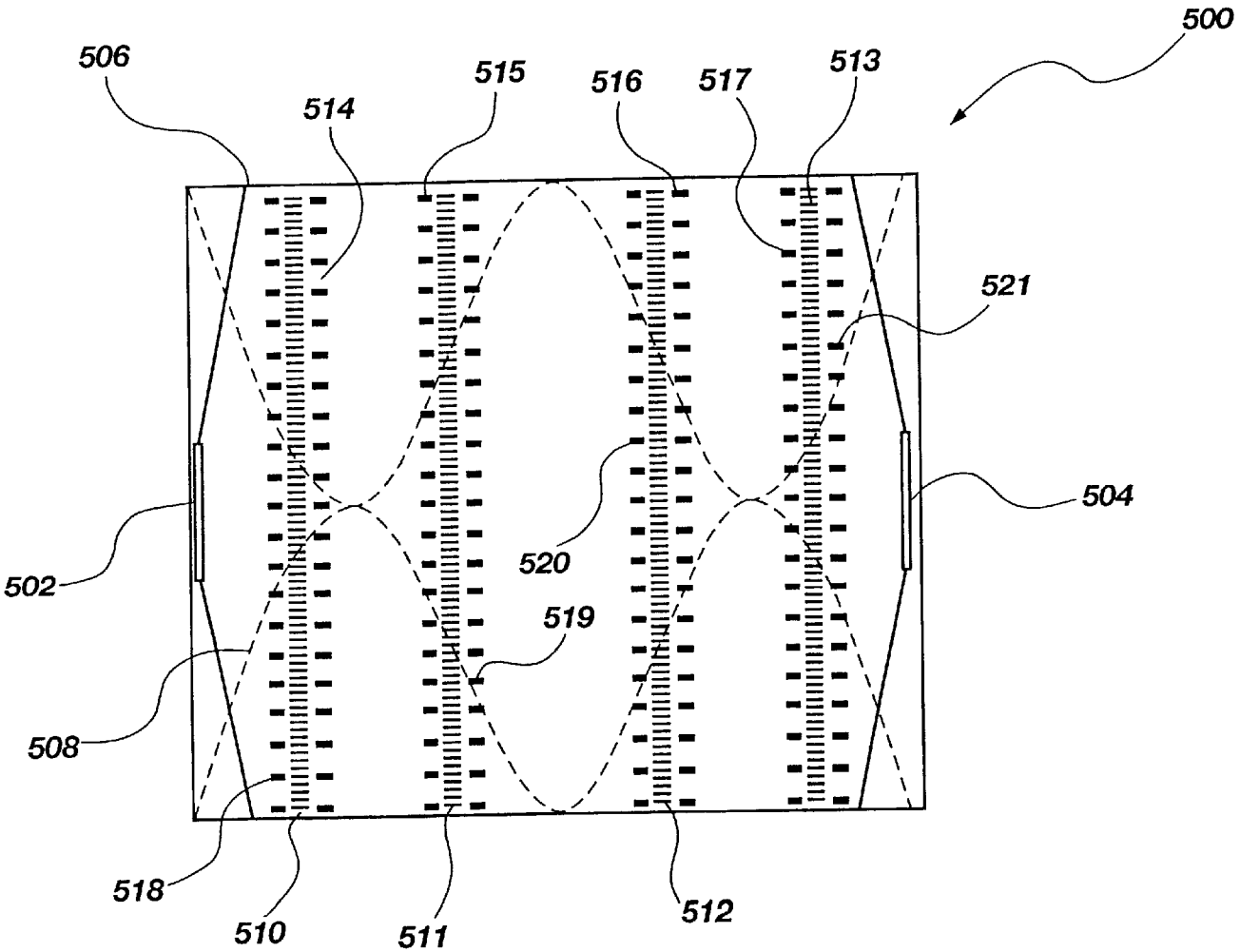
FIG. 13 is a cross-sectional side view of a eighth embodiment of a compact thermoacoustic refrigerator in accordance with the principles of the present invention.

FIG. 13 illustrates yet another preferred embodiment of a thermoacoustic refrigerator, generally indicated at 500, in which multiple drivers and multiple stacks are utilized to provide more cooling power per unit volume of the resonator 506. The refrigerator is essentially comprised of two single driver/double stack thermoacoustic refrigerators facing one another. In such an arrangement, two stacks and their associated heat exchangers are placed at optimal locations relative to each half wavelength of the standing wave 508. Thus, four stacks 510, 511, 512 and 513 with their associated cold heat exchangers 514, 515, 516 and 517 and hot heat exchangers 518, 519, 520 and 521 utilize the standing wave 508 generated by the drivers 502 and 504 provide more cooling power than a single stack arrangement.

Figure 14:
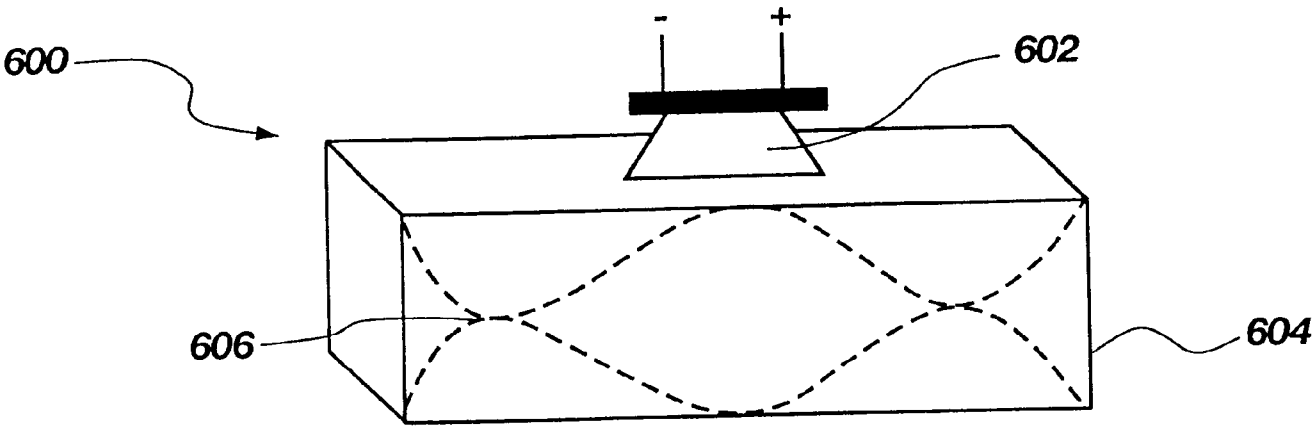
FIG. 14 is a cross-sectional side view of a ninth embodiment of a compact thermoacoustic refrigerator in accordance with the principles of the present invention.

FIG. 14 illustrates a rectangular or cube-like shaped thermoacoustic refrigerator 600. A speaker 602 is located in the top of the resonator 604 to produce a standing wave 606 within the resonator 604. As with the other embodiments provided herein, stack/heat exchanger arrangements can then be placed within the resonator 604 at desired locations depending on the location of stack/heat exchanger that achieves the best cooling performance relative to the standing wave 606.

Figure 15:
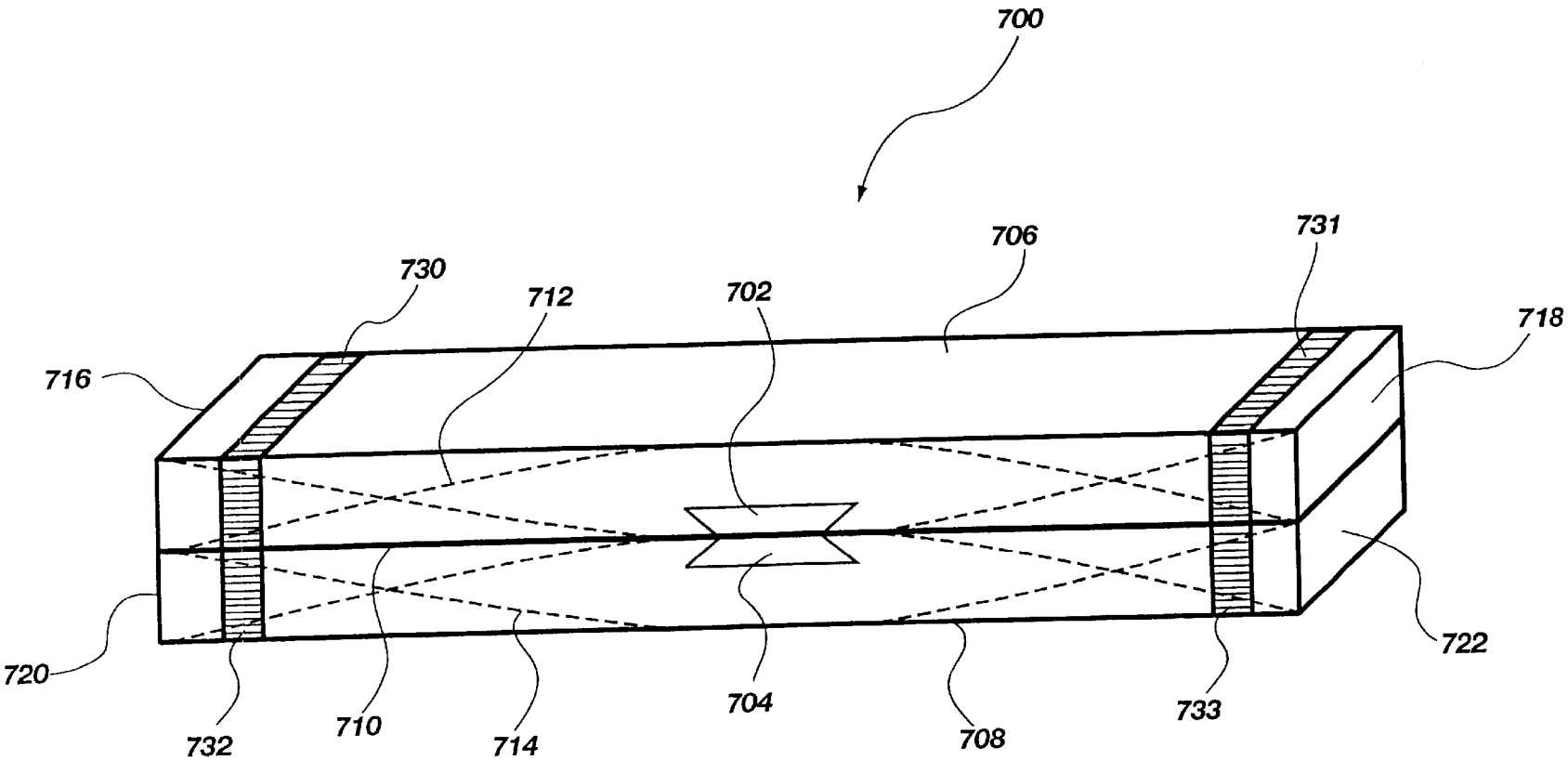
FIG. 15 is a cross-sectional side view of a tenth embodiment of a compact thermoacoustic refrigerator in accordance with the principles of the present invention.

Referring now to FIG. 15, a double rectangular-shaped thermoacoustic refrigerator 700. The speakers or drivers 702 and 704 are located in the center of the resonators 706 and 708 along the interface 710 between the two resonators 706 and 708. The drivers 702 and 704 produce standing waves 712 and 714 that extend to the ends 716 and 718 of the resonator 706 and to the ends 720 and 722 of the resonator 708, respectively. As such, the stack/heat exchanger assemblies 730, 731, 732 and 733 can be located proximate the ends 716, 718, 720 and 722 of the resonators 706 and 708 in order to allow for easy summation of their cooling power as well as for ease of conducting such cooling power to a desired location such as a microprocessor, microchip, or other electronic device or component. Thus, by locating the driver in the center of the resonator while the standing waves extend to the ends of the resonator, the quality factor Q can be improved simultaneously by removing the driver from participating in the resonance. Moreover, as previously indicated, such a rectangular configuration is often more conducive for use on circuit boards and the like.

Figure 16:
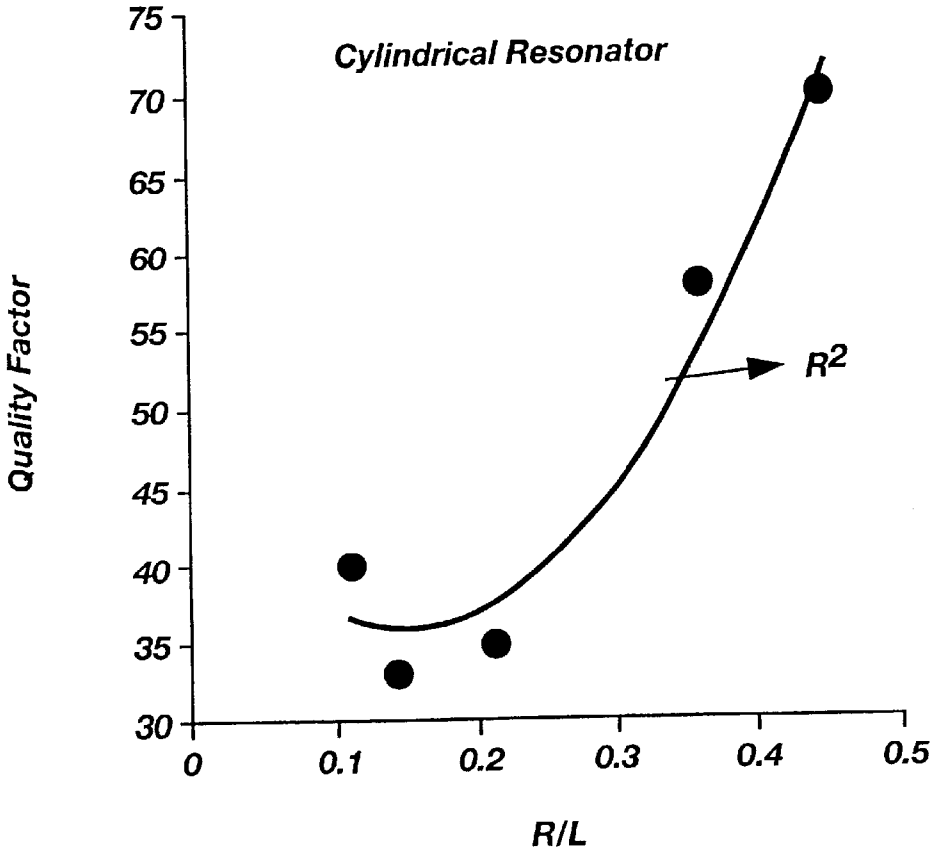
FIG. 16 is a graph showing the quality factor of cylindrical resonator in accordance with the present invention versus the size of the resonator.

FIG. 16 is a graphical representation of the quality factor for a half wavelength cylindrical resonator as a function of the resonator radius divided by the length of the resonator. As illustrated, the performance or quality of the device increases as the radius approaches approximately 0.5 of the length of the resonator. Thus, it is desirable in accordance with the present invention to provide such resonators having a radius, or effective radius for non-cylindrical resonators, of about 0.5 the length of the resonator.

Figure 17:
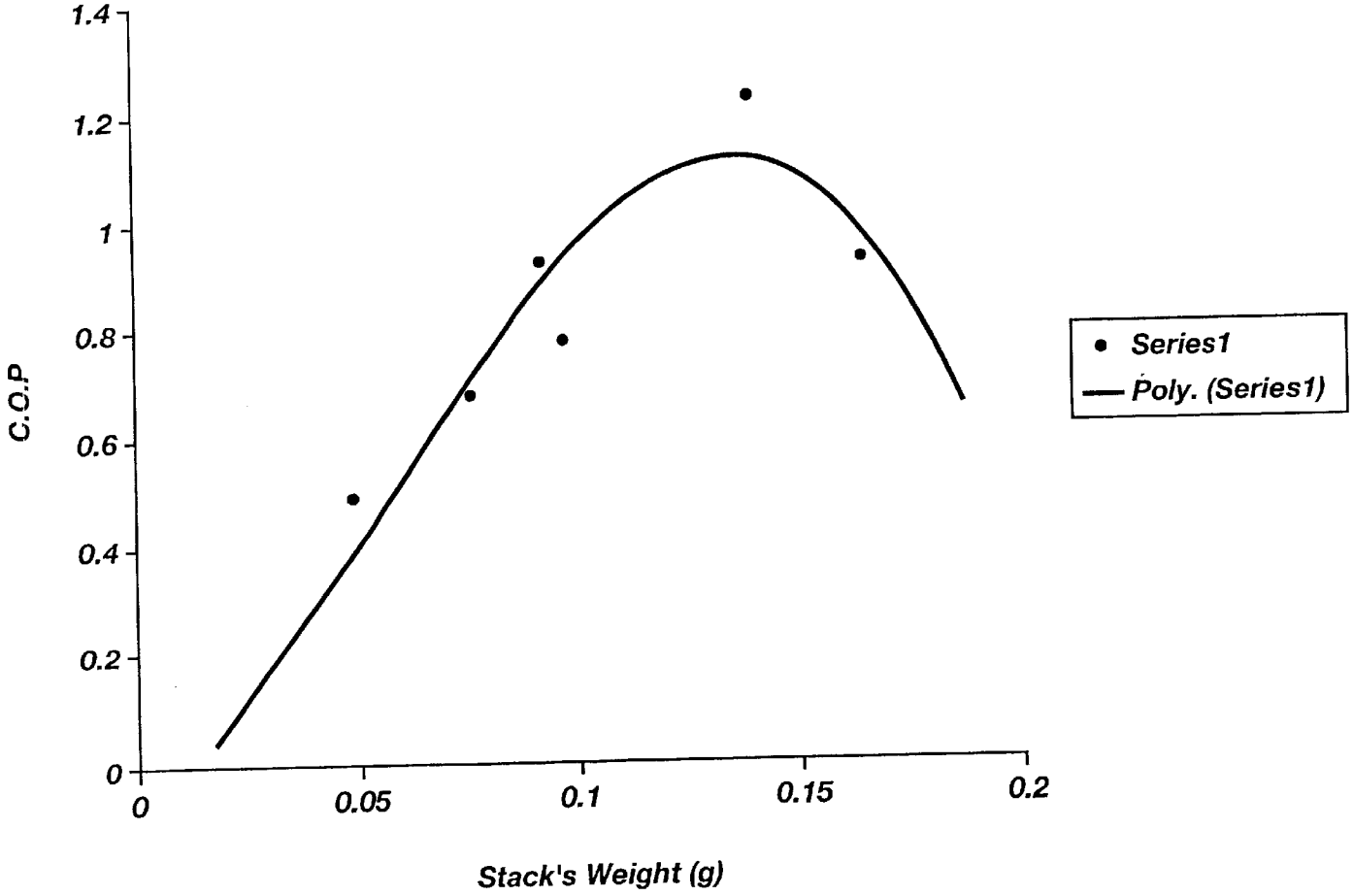
FIG. 17 is a graph showing the performance of the resonator versus the weight of the stack.
Figure 18:
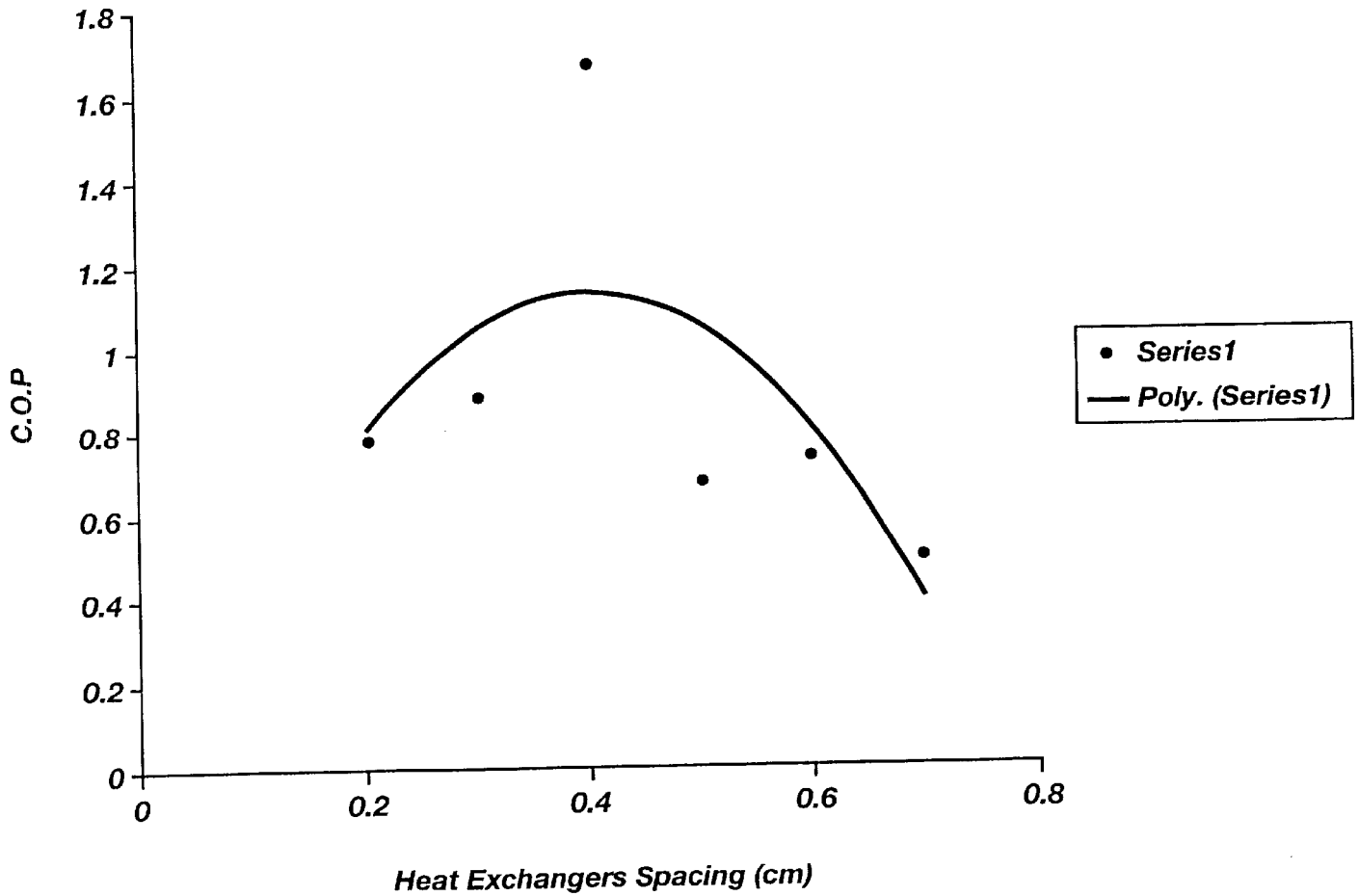
FIG. 18 is a graph showing the performance of the resonator versus the relative spacing of the heat exchangers.

As further illustrated in FIGS. 17 and 18, in order to maximize the performance of the thermoacoustic refrigerators in accordance with the present invention, the weight of the stack (FIG. 17) and the spacing of the heat exchangers (FIG. 18) were varied to analyze their effects on performance. These tests were conducted on a thermoacoustic refrigerator having a resonator diameter of 4.1 cm and a length of 4.1 cm. The stack material utilized in these tests was glass wool. For this size of resonator, the best performance is achieved with a stack having a weight of roughly between 0.1 grams and 0.15 grams. For heat exchanger spacing, the heat exchangers performed best with a spacing of roughly between 0.3 and 0.5 centimeters. As such, the optimal spacing or stack thickness has been shown to be about 10% of the resonator length (i.e., 10% of half the wavelength of the standing wave). It should be noted that as the diameter of the resonator increases, there will be more stack material in the stack for a given thickness of the stack and density of the stack material. Based upon these results, it appears that for the size of resonator used and the stack material, the optimal density of the stack material is about 0.022 g/cc. Moreover, the filling factor, which is the volume of stack space occupied by the stack material, is approximately 2.5% and thus preferably between about 1 and 5%. The filling factor is calculated by dividing the volume of the stack material by the volume of the stack space where the volume of the stack space is the stack length times the cross-sectional area of the stack (i.e., the cross-sectional area of the resonator). Such results provide a basis for determining the optimal stack density and/or filling factor for any desired stack material, resonator size, stack thickness, and the like in accordance with the present invention. Thus, by knowing the filling factor and/or density of the stack material used to fill the void between the heat exchangers, the cooling efficiency of the thermoacoustic refrigerator of the present invention can be maximized. Experiments using stack materials such as cotton wool or a glass wool, similar to insulation material, have produced promising results, and of the two, glass wool has unexpectedly been found to significantly outperform cotton wool. Glass wool has a consistency similar to cotton candy, but is less effected by humidity than cotton wool. In addition, glass wool retains its springiness, and thus its surface area, when compacted between the heat exchangers. Another desirable material for the stack is an aerogel. An aerogel is essentially a linked silica network that is formed by drying a silica gel while maintaining the shape of the gel during the drying process. What remains after drying is an intricate open-pore silica (i.e., silicon dioxide) structure that is extremely lightweight with high surface area. Such aerogels are commonly used in the aerospace industry as filtering media for collecting and returning samples of high-velocity cosmic dust. Aerogels have apparent densities ranging from 0.003–0.35 g/cc. The most common density of about 0.1 g/cc. The internal surface area of such aerogels is in the range of about 600 to 1000 $m^2/g$ as determined by nitrogen adsorption/desorption. The percent of solids in aerogels is about 0.13–15% and typically about 5% with 95% free space. The mean pore diameter is approximately 20 nm as determined by nitrogen adsorption/desorption and varies with density of the aerogel. The primary particle diameter which forms the aerogel structure is about 2–5 nm as determined by electron microscopy. The coefficient of thermal expansion is about $2.0–4.0\times10^6$ as determined using ultrasonic methods. As such, aerogels are extremely porous and provide a large surface area for interacting with the standing wave generated in a resonator in accordance with the present invention. It may also be preferably to have parallel channels along the direction of the sound field to provide low resistance passageways for the sound without substantially reducing the quality factor Q of the resonator.

In order to enhance the performance of such a thermoacoustic refrigerator, the small size of such a device allows the refrigerator to be pressurized to a higher pressure than other devices known in the art. Also, the working fluid may be changed from air to some other gas or combination of gases. Since a limiting factor is the viscous boundary layer characterized by a viscous penetration depth $\delta_v$. It is appropriate to choose a fluid with a low Prandtl number such as a mixture of 64% He and 36% Ar whose Prandtl number is 0.3507 and where the speed of sound is 497 m/sec. Compared to air this required a scaling factor of 1.4 in size to keep the resonance at the same frequency as for air.

The improved performance which can be achieved when the fluid is at higher pressures is due to scaling similitude principles and to the superior impedance matching between the driver and the fluid. Working at high pressure is an advantage with the present invention since a small refrigerator is structurally strong enough to withstand very high pressures.

The maximum temperature difference that can be produced across a stack results from a competition between the temperature change due to an adiabatic pressure change of the working fluid and its displacement along the stack which has a temperature gradient. When the temperature rise due to an adiabatic compression is greater than the temperature rise due to the displacement along a temperature gradient of the stack, the engine works as a heat pump or refrigerator. Conversely, the engine works as a prime mover. The critical gradient $\nabla T_{crit}$ given above separates the two regimes. This fundamental limitation is overcome by the present invention. First, the use of two stacks and corresponding heat exchangers inside a double ½0 wave resonator allows the $\Delta T$ of each to be cascaded. This is particularly important for the ultrasonic regime where the wavelength is short and hence the stack used will also be short. Second, the stack length $\Delta x$ can be increased by using a fluid where the speed of sound is higher than in air.

The gradual transport of heat along the stack during refrigeration operation ends when the symmetry is broken at each end and hence a heat exchanger is needed at each end to dispose of the heat or absorb it. At the cold end the interface has to transfer heat $Q_c$ while at the hot end the heat transferred there is $Q_c$+W, where W is the work done on the system by sound. Since at the interface of stack-heat exchanger heat is transferred by thermal contact of the cotton wool fibers to the heat exchangers, the contact thermal resistance can limit the flow of heat. This is reduced by the shuffling action of the sound field which moves the heat in small steps along the stack and across-small enough gaps between the heat exchangers and the stack.

A contact thermal resistance $R_{co}$ can be defined as:

$$R_{co}=1/h_{co}A_e$$

where $h_{co}=1.25\ k_s\ (m/\sigma)\ (P/H)$ with $k_s$ being a harmonic mean thermal conductivity for the 2 solids in contact, $\sigma$ is a measure of surface roughness of the 2 solids, m is related to angles of contact, P is the contact pressure and H is the microhardness of the softer solid. For a transistor casing and a nylon washer this resistance is 2° C./W while for transistor in contact with air it is 5° C./W. For cotton wool to heat exchanger interface, the thermal resistance is estimated to be $R_{co}$=3.5–7° C./W. For a total heat flow of 2 watts the interfaces can easily develop a $\Delta T$ of 7–15° C. Moreover, closer examination of a random stack shows that it is formed from several layers of cotton wool pressed together with a large fraction of fibers aligned perpendicular to the axis of heat transport. A more random distribution of fibers and preferably a longitudinal alignment of fibers along the axis of the heat transport would give improved performance.

An important function of the stack is the storage and rectification of heat flow as it is being shuffled from one end of the stack to the other. This requires a large surface area; cotton wool is exceptionally well-suited for this task. A cotton wool stack offers an enormous surface area (e.g., around 5,000 $cm^2$). It occupies 1–5% of the stack volume with the rest being air. The thickness of such a stack should be calculated to accommodate for the thermal penetration depth around each fiber. For short stacks, a random fiber approach provides improved performance by providing a larger interaction with the sound field as compared to the prior art Mylar sheets and leads to simplicity in the construction of the stack.

The use of multiple stacks as herein described, overcomes many of the limitations of the prior art. For example, by cascading stacks in series thermally, improved efficiency can be achieved with the possibility of opening the way for very low temperature refrigeration using thermoacoustics. In addition, operation at high frequencies requires all the dimensions, including the stack, to be reduced. Utilizing multiple stacks, however, in cascade overcomes the problem of the small thickness of each stack thus making it possible to go to the ultrasonic range.

When operating a thermoacoustic refrigerator in accordance with the present invention at high frequencies, the cone may not be necessary when the pressure of the working fluid is raised since the impedance match between the driver and working fluid will be improved. As such, another advantage of high frequency operation and thus a smaller device is that very high fluid pressure can be used before limitations of strength of materials come into effect since the surface area of such a device is quite small. In addition, an important consideration for high frequency operation of this refrigerator is that large critical gradients $\nabla T_{crit}$ can be attained. Since this parameter is essentially $T_1/x_1$, the temperature change $T_1$ due to the acoustic pressure variation $P_1$ and the displacement $x_1$ in the sound wave leads to a large temperature change $T_1$ with small displacement $x_1$ since $x_1=u_1/\omega$ (where $u_1$ is the particle speed in the sound field). Compression and expansion in a sound field causes a gas temperature oscillation which leads to a temperature difference between the gas and the stack. Such temperature difference causes a heat flow from gas to stack on the high pressure part of the cycle. On the other hand, a temperature gradient along the stack causes a reverse heat flow from stack to gas when the stack is hotter than the gas. In essence, heat is pumped from cold to hot when the acoustically produced gradient is less than the critical temperature gradient across the stack. This shows how a small $x_1$ and large $P_1$ can lead to a large temperature difference across the stack and hence to a low minimal temperature.

High frequency operation also favors a high power density. The energy flux per unit volume is proportional to the pump frequency. Power densities of approximately 10 $W/cm^3$ can be achieved at about 5,000 Hz at relatively high sound levels.

Finally, high frequency operation for a resonant system leads to small total volume for the refrigerator. This is particularly useful for applications where compactness and rapid cool-down are important factors.

It will be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A compact thermoacoustic refrigerator, comprising:

a first resonator having a first end and a second end, said first resonator defining an interior chamber having a length approximately equal to an effective diameter;

a working fluid disposed within said interior chamber;

a first high frequency driver disposed in communication with said working fluid for generating at least a portion of a first standing wave within said chamber;

a first stack disposed within said first resonator between said first high frequency driver and said second end and having a first side and a second side, said first stack formed from fibers; and a first pair of heat exchangers, one of said pair positioned adjacent said first side of said stack and the other of said pair positioned adjacent said second side of said stack.

2. The compact thermoacoustic refrigerator of claim 1, wherein said first resonator defines a generally cylindrical chamber having first and second closed ends and having a length and diameter approximately equal to half the wavelength of said first standing wave produced by said first driver.

3. The compact thermoacoustic refrigerator of claim 2, wherein said first stack has a thickness of approximately 0.1 of the length of said first resonator.

4. The compact thermoacoustic refrigerator of claim 2, wherein said first stack has a volume filling factor of approximately one to five percent.

5. The compact thermoacoustic refrigerator of claim 4, wherein said pair of heat exchangers have a spacing of approximately ten percent of half the wavelength of the first standing wave.

6. The compact thermoacoustic refrigerator of claim 5, wherein a density of said first stack is approximately 0.2 g/cc.

7. The compact thermoacoustic refrigerator of claim 1, wherein said first stack has a thickness of approximately ten percent of a length of said first resonator.

8. The compact thermoacoustic refrigerator of claim 1, wherein a filling factor of said first stack is approximately 1 to 5 percent.

9. The compact thermoacoustic refrigerator of claim 1, wherein said fibers are comprised of at least one of cotton wool and glass wool.

10. The compact thermoacoustic refrigerator of claim 1, further including a second stack and a second pair of heat exchangers associated with said second stack disposed between said first stack and said second end of said first resonator.

11. The compact refrigerator of claim 10, wherein said first resonator has a length approximately equal to one wavelength of the sound produced by said driver.

12. The compact refrigerator of claim 11, further including a third stack, a third pair of heat exchangers associated with said third stack, a fourth stack and a fourth pair of heat exchangers associated with said fourth stack.

13. The compact thermoacoustic refrigerator of claim 1, wherein said working fluid is selected from at least one of air, an inert gas and mixtures of inert gases.

14. The compact thermoacoustic refrigerator of claim 1, wherein said first high frequency driver is comprised of a piezoelectric driver for producing sound at a frequency above 4,000 Hz.

15. The compact thermoacoustic refrigerator of claim 1, further including a second high frequency driver disposed in communication with said working fluid for generating at least a portion of a second standing wave within said chamber.

16. The compact thermoacoustic refrigerator of claim 15, wherein said first and second high frequency drivers are positioned on opposite ends of said chamber.

17. The compact thermoacoustic refrigerator of claim 1, wherein said first resonator defines a generally rectangularly shaped chamber.

18. The compact thermoacoustic refrigerator of claim 17, further including a second chamber defined by a second resonator, said first and second resonators coupled together.

19. The compact thermoacoustic refrigerator of claim 18, further including a second high frequency driver, said first and second high frequency drivers positioned back-to-back.

20. A compact thermoacoustic refrigerator, comprising:

a first resonator having a first end and a second end and defining a first sealed chamber;

a working fluid disposed within said first sealed chamber;

a first driver disposed in communication with said first resonator proximate said first end thereof;

a first stack, disposed within said first resonator and positioned between said first driver and said second end and having a first side and a second side formed from random fibers;

a first heat exchanger adjacent said first side of said first stack; and a second heat exchanger adjacent said second side of said first stock.

21. The compact thermoacoustic refrigerator of claim 20, wherein said first resonator defines a generally cylindrical chamber having first and second closed ends and having a length and effective diameter approximately equal to half the wavelength of a first standing wave produced by said first driver.

22. The compact thermoacoustic refrigerator of claim 20, wherein a said first stack is configured to be longitudinally adjustable relative to said first resonator for tuning.

23. The compact thermoacoustic refrigerator of claim 20, further including means for adjusting said first stack relative to said first resonator for optimizing the cooling efficiency.

24. The compact thermoacoustic refrigerator of claim 20, wherein said first resonator defines a generally cylindrical chamber having first and second closed ends and a length approximately equal to more than one half wavelength of a standing wave produced by said first driver.

25. The compact thermoacoustic refrigerator of claim 24, further including a second stack disposed between said first stack and said second end of said first resonator.

26. The compact thermoacoustic refrigerator of claim 20, wherein said working fluid is selected from at least one of air, an inert gas and mixtures of inert gases.

27. The compact thermoacoustic refrigerator of claim 20, wherein said first stack has a thickness of approximately 0.1 of the length of said resonator.

28. The compact thermoacoustic refrigerator of claim 20, wherein said first and second heat exchangers have a spacing of approximately ten percent of half the wavelength of the first standing wave.

29. The compact thermoacoustic refrigerator of claim 28, wherein a density of said first stack is approximately 0.2 g/cc.

30. The compact thermoacoustic refrigerator of claim 20, wherein said first stack has a thickness of approximately ten percent of a length of said first resonator.

31. The compact thermoacoustic refrigerator of claim 20, wherein a filling factor of said first stack is approximately 1 to 5 percent.

32. The compact thermoacoustic refrigerator of claim 20, wherein said random fibers are comprised of at least one of cotton wool and glass wool.

33. The compact thermoacoustic refrigerator of claim 20, further including a second stack and third-and fourth heat exchangers associated with said second stack, said second stack disposed between said first stack and said second end of said first resonator.

34. The compact refrigerator of claim 33, wherein said first resonator has a length approximately equal to one wavelength of the sound produced by said first driver.

35. The compact refrigerator of claim 34, further including a third stack and fifth and sixth heat exchangers associated with said third stack, a fourth stack and seventh and eighth heat exchangers associated with said fourth stack.

36. The compact thermoacoustic refrigerator of claim 20, wherein said working fluid is selected from at least one of air, an inert gas and mixtures of inert gases.

37. The compact thermoacoustic refrigerator of claim 20, wherein said first driver is comprised of a piezoelectric driver for producing sound at a frequency above 4,000 Hz.

38. The compact thermoacoustic refrigerator of claim 20, further including a second driver disposed in communication with said working fluid for generating at least a portion of a second standing wave within said chamber.

39. The compact thermoacoustic refrigerator of claim 38, wherein said first and second drivers are positioned on opposite ends of said chamber.

40. The compact thermoacoustic refrigerator of claim 20, wherein said first resonator defines a generally rectangularly shaped chamber.

41. The compact thermoacoustic refrigerator of claim 40, further including a second chamber defined by a second resonator, said first and second resonators coupled together.

42. The compact thermoacoustic refrigerator of claim 41, further including a second driver, said first and second drivers positioned back-to-back.

* * * * *